US010344440B2

(12) United States Patent
Surjaatmadja

(10) Patent No.: US 10,344,440 B2
(45) Date of Patent: Jul. 9, 2019

(54) SOIL AND ROCK GROUTING USING A HYDRAJETTING TOOL

(71) Applicant: Halliburton Energy Services, Inc., Houston, TX (US)

(72) Inventor: Jim Basuki Surjaatmadja, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/113,235

(22) PCT Filed: Apr. 7, 2014

(86) PCT No.: PCT/US2014/033145
§ 371 (c)(1),
(2) Date: Jul. 21, 2016

(87) PCT Pub. No.: WO2015/156757
PCT Pub. Date: Oct. 15, 2015

(65) Prior Publication Data

US 2017/0002535 A1 Jan. 5, 2017

(51) Int. Cl.
*E21B 33/138* (2006.01)
*E02D 3/12* (2006.01)
(Continued)

(52) U.S. Cl.
CPC ..... *E02D 3/12* (2013.01); *E02D 19/16* (2013.01); *E02D 31/08* (2013.01); *E02D 37/00* (2013.01); *E02D 2300/0037* (2013.01)

(58) Field of Classification Search
CPC ..... E02D 3/12; E02D 19/16; E02D 31/08; E02D 37/00; E02D 2300/0037; E02D 15/04; E21B 33/13; E21B 33/138
See application file for complete search history.

(56) References Cited

U.S. PATENT DOCUMENTS 4,605,339 A 8/1986 Builivant
4,971,480 A * 11/1990 Nakanishi ..... E02D 3/12 405/263

(Continued)

OTHER PUBLICATIONS

Hayward Baker, Cementing Grouting & Micropiles, City Place Station, Dallas, TX. (not dated).

(Continued)

*Primary Examiner* — Carib A Oquendo
(74) *Attorney, Agent, or Firm* — Gilliam IP PLLC

(57) ABSTRACT

Methods including providing a hydrajetting tool comprising a housing having a top end and a bottom end and having a plurality of jetting nozzles disposed thereon, the top end of the housing fluidly coupled to a tool string; providing at least one sub-soil-surface cavity adjacent to or in unstable soil, the unstable soil having a plurality of channels therein; introducing the hydrajetting tool into the at least one sub-soil-surface cavity; injecting a cement slurry through at least one of the jetting nozzles and into the sub-soil-surface cavity; permeating the cement slurry into the plurality of channels in the unstable soil; filling the at least one sub-soil-surface cavity with the cement slurry; and curing the cement slurry, thereby forming a stable soil and a cement pillar in the at least one sub-soil-surface cavity.

19 Claims, 4 Drawing Sheets

(51) Int. Cl.

| | |
|---|---|
| ***E02D 19/16*** | (2006.01) |
| ***E02D 31/08*** | (2006.01) |
| ***E02D 37/00*** | (2006.01) |

(56) References Cited

U.S. PATENT DOCUMENTS 5,006,017 A * 4/1991 Yoshida ..... E02D 3/12 405/263
5,085,276 A * 2/1992 Rivas ..... E21B 43/26 166/303
5,123,782 A * 6/1992 Yoshida ..... E02D 3/12 405/233
5,141,366 A * 8/1992 Ishida ..... A01G 25/00 405/263
5,181,797 A 1/1993 Circeo, Jr. et al.
5,765,642 A 6/1998 Surjaatmadja
5,803,664 A * 9/1998 Kawabata ..... B09C 1/10 166/246
6,662,874 B2 12/2003 Surjaatmadja et al.
6,719,054 B2 4/2004 Cheng et al.
6,739,806 B1 5/2004 Szymanski et al.
6,779,607 B2 8/2004 Middaugh et al.
7,617,871 B2 11/2009 Surjaatmadja et al.
7,866,922 B2 * 1/2011 Melegari ..... E02D 5/76 405/231
2003/0056953 A1 3/2003 Tumlin et al.
2004/0163807 A1 * 8/2004 Vercaemer ..... E21B 33/13 166/250.12
2004/0175242 A1 * 9/2004 Kim ..... E02D 3/126 405/269
2005/0230107 A1 10/2005 McDaniel et al.
2010/0212903 A1 8/2010 Dotson et al.
2011/0044769 A1 * 2/2011 Siepi ..... E02D 3/12 405/267
2011/0070033 A1 3/2011 Melegari et al.
2012/0111566 A1 * 5/2012 Sherman ..... E21B 34/063 166/297
2012/0305679 A1 12/2012 Surjaatmadja et al.
2015/0166873 A1 * 6/2015 Tomlinson ..... C09K 8/487 166/293
2015/0240598 A1 * 8/2015 Zhou ..... E21B 34/14 166/305.1
2016/0325323 A1 * 11/2016 Heuser ..... B09C 1/02
2017/0204580 A1 * 7/2017 Haneda ..... E02D 3/12

OTHER PUBLICATIONS

Hayward Baker, Chemical Grouting Groundwater Control & Excavation Support, Waste Water Treatment Plant, West Palm Beach, Florida (not dated).
International Search Report and Written Opinion for PCT/US2014/033145 dated Jan. 5, 2015.

* cited by examiner

SOIL AND ROCK GROUTING USING A HYDRAJETTING TOOL

BACKGROUND

The embodiments in the present disclosure relate to soil and rock grouting using a hydrajetting tool. Specifically, the embodiments of the present disclosure relate to using a hydrajetting tool to inject curable cement slurries into unstable soil and rock, referred to herein as "grouting," and all of its grammatical variants, to stabilize the unstable soil and rock.

Roads, structures, and other infrastructure (collectively referred to herein as "infrastructure") may be placed atop a soil-based substrate. As used herein, the term "soil-based substrate," "soil," and all grammatical variants thereof refers to the upper layer of earth which may be dug, plowed, and/or which plants may grow, typically comprising organic remains, clays, and other particulates. In some instances, the soil substrate may have poor load bearing capacity (e.g., load bearing strength and capacity). Such soil may be referred to as "unstable soil," or soil that because of its nature or the influence of related conditions, cannot be depended upon to remain in place without extra support. For example, soil may be unstable if it has a plurality of flow paths running throughout (e.g., it is loosely packed) or if it has been or is expected to be exposed to significant wetting that may lead to such flow paths. Soil may additionally be unstable if it contains constituents that are particularly brittle or otherwise subject to crushing upon encountering loads associated with most infrastructure that may lead to flow paths. Such unstable soil may result in infrastructure foundation or other structural damage (e.g., cracking and uneven surfaces in roads, walls or buildings), which could lead to substantially costly repairs, as well as danger to human life.

In some instances, infrastructure may be placed upon a rock formation. As used herein, the term "rock formation," "rock," and any grammatical variants thereof refers to natural substantially solid mineral material as part of the earth, exposed or underlying soil and manmade substantially solid mineral material (e.g., foundation for infrastructure formed from rock). Such rocks may be themselves unstable and have poor load bearing capacity. Such "unstable rock formations" or "unstable rock," including all of its grammatical variants, may be characterized, for example, as having cracks or other discontinuities running therethrough that decrease its load bearing capacity. Natural rock formations may become unstable over time by erosion or other exposure to the natural elements. Some manmade rock formations may become unstable for a number of reasons including, for example, poor curing of the foundation material (e.g., ineffective hydration of cements) or particularly arid or dry conditions leading to cracking (i.e., drought conditions). Such unstable rock having infrastructure placed thereon, like the unstable soil, may result in costly damage to the infrastructure, as well as danger to human life.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1A:
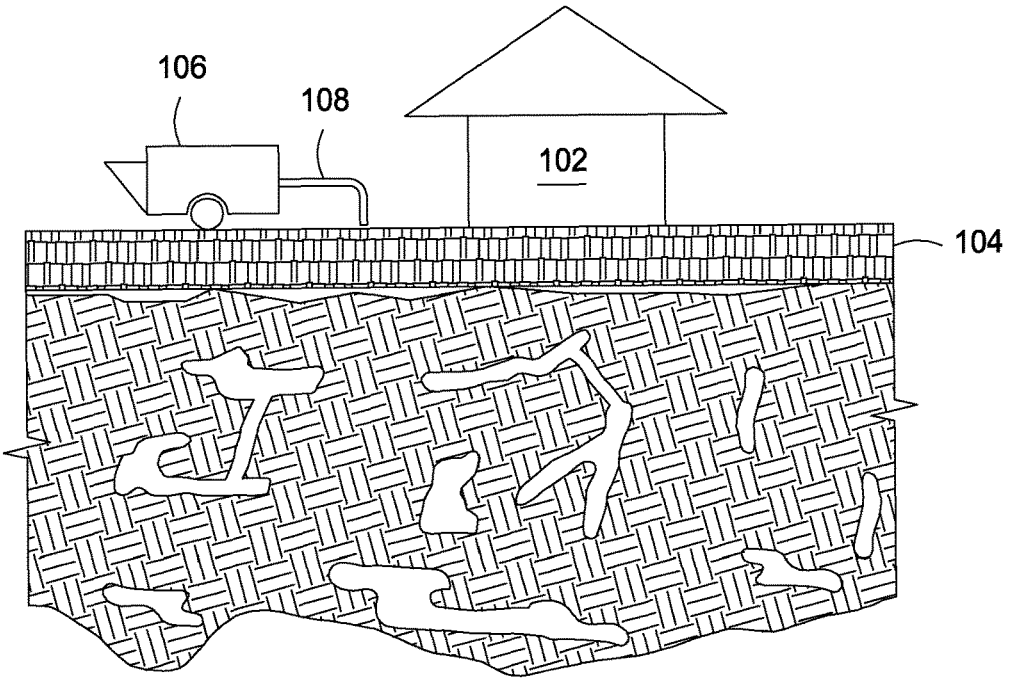
FIG. 1A (Prior Art)
FIGS. 1A-1B depict a conventional grouting process.

The embodiments in the present disclosure relate to soil and rock grouting using a hydrajetting tool. Specifically, the embodiments of the present disclosure relate to using a hydrajetting tool to inject curable cement slurries into unstable soil and rock, referred to herein as "grouting," and all of its grammatical variants, to stabilize the unstable soil and rock.

One or more illustrative embodiments disclosed herein are presented below. It is understood that figures provided herein to illustrate such embodiments are not necessarily drawn to scale and should not be interpreted as such. Not all features of an actual implementation are described or shown in this application for the sake of clarity. It is understood that in the development of an actual embodiment incorporating the embodiments disclosed herein, numerous implementation-specific decisions must be made to achieve the developer's goals, such as compliance with system-related, lithology-related, business-related, government-related, and other constraints, which vary by implementation and from time to time. While a developer's efforts might be complex and time-consuming, such efforts would be, nevertheless, a routine undertaking for those of ordinary skill in the art having benefit of this disclosure.

It should be noted that when "about" is provided herein at the beginning of a numerical list, the term modifies each number of the numerical list. In some numerical listings of ranges, some lower limits listed may be greater than some upper limits listed. One skilled in the art will recognize that the selected subset will require the selection of an upper limit in excess of the selected lower limit. Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the exemplary embodiments described herein. At the very least, and not as an attempt to limit the application of the doctrine of equivalents to the scope of the claim, each numerical parameter should at least be construed in light of the number of reported significant digits and by applying ordinary rounding techniques.

While compositions and methods are described herein in terms of "comprising" various components or steps, the compositions and methods can also "consist essentially of" or "consist of" the various components and steps. When "comprising" is used in a claim, it is open-ended.

In conventional grouting applications, drill bits or augers are equipped with nozzles and used together to mix cement and loose soil to stabilize the soil, creating "soil cement." Generally, loose soil is prevalent in manmade situations. For example, the Narita Airport near Tokyo, Japan is built on manmade land formed by compacting components, such as rocks, sand, and the like, atop the ocean floor. Initial estimates indicating a sink rate for the airport of about 2.5 cm/year have been significantly off, and the airport is sinking at a much faster rate. Despite the probability of sinking (e.g., due to formation of loose soil or rock), the popularity of building such manmade infrastructure is on the rise (e.g., Singapore has been and continues to extend its beaches, Dubai has created the "The World" islands, and the like). Conventional methods of grouting, however, may fail to provide support for all of the areas where loose soil is commonplace. For example, in conventional grouting applications, the cement soil forms pillars that are limited to the size of the drill bit or auger itself. In order to reach outside of these areas, additional drilling is required, translating into potentially significant costs and time.

Figure 1B:
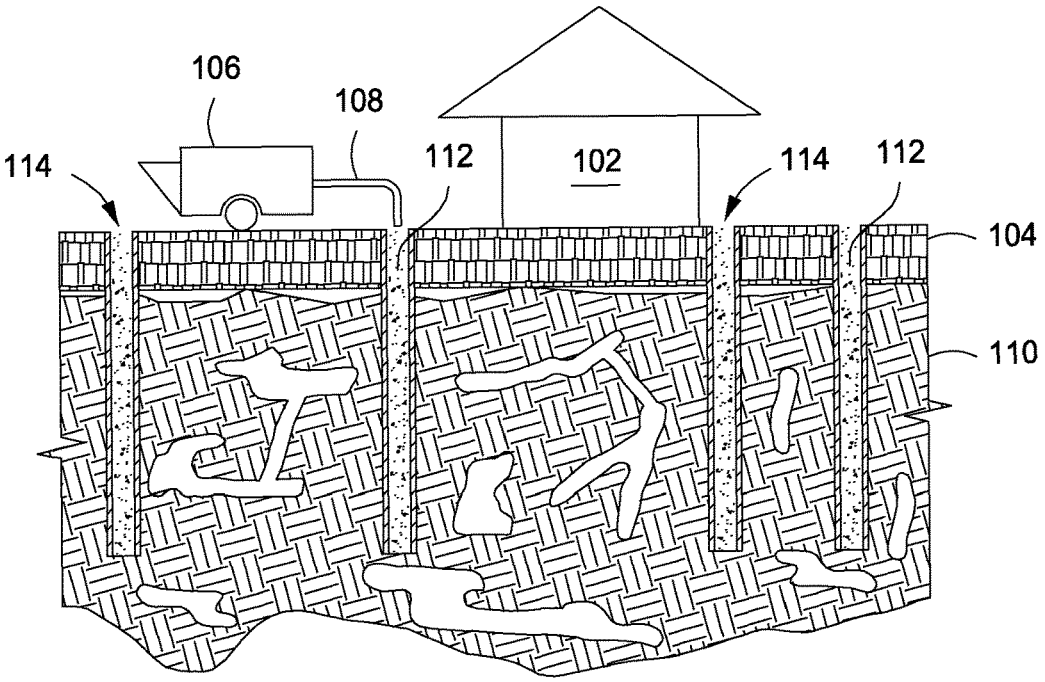
FIG. 1B (Prior Art)

Referring now to FIGS. 1A-1B, illustrated is an example of conventional grouting process. FIG. 1A depicts infrastructure 102 positioned atop a foundation 104. A cement pump 106 fluidly connected to a tubular 108 may be configured to have a drill bit or auger fluidly connected thereto (not shown). The drill bit or auger may further have a nozzle such that the drill bit or auger may eject cement during drilling to form soil cement, as discussed above. Referring now to FIG. 1B, the cement pump 106 may be used to drill and/or inject cement into already drilled holes through the foundation 104 and into unstable soil 110. As depicted in FIG. 1B, sub-surface cavities 114 may be pre-formed (e.g., drilled by means other than a drill bit or auger connected to the tubular 108) or formed by a drill bit or auger connected to the tubular 108 (not shown). A cement is pumped into the sub-surface cavities 114 through the tubular 108 by use of the cement pump 106 and the cement cured to form grouting pillars 112 (four shown). The cement pillars 112 are generally limited to the size of the drill bit (i.e., the drill hole in the unstable soil 110). Conventional grouting processes may permit the formation of deep cement pillars (e.g., about 3 m-66 m (or about 10 ft-20 ft)) in the unstable soil 110 and may allow the cement to squeeze into limited neighboring areas of the unstable soil 110, characterized by cavities (e.g., holes) connected to the sub-surface cavity 114 or particularly soft and loose particulates.

The present disclosure may permit the formation of cement pillars that are significantly larger in diameter than the sub-surface cavity created to facilitate their formation. As such, fewer sub-surface cavities are needed to grout and stabilize a much larger portion of unstable soil or rock. Such benefits increase the time and cost of a particular grouting stabilization job, increase the reach and stability of the grouting stabilization job, and permit greater reach of the grouting cement slurry composition beneath infrastructure, among other benefits.

In some embodiments, the present disclosure provides a method of providing a hydrajetting tool having one or more jetting nozzles thereon. One or more sub-soil-surface cavities may be present in or adjacent to an unstable soil composition. In some embodiments, the hydrajetting tool may be used to form the one or more sub-soil-surface cavities. The hydrajetting tool may be introduced into a sub-soil-surface cavity and a cement slurry may be injected through one or more of the jetting nozzles and into unstable soil, the unstable soil having a plurality of channels therein. The cement slurry may be permeated into at least a portion of the plurality of channels in the unstable soil. The cement slurry may also fill the sub-soil-surface cavity. Thereafter, the cement slurry may cure, thereby forming stable soil and a cement pillar in the at least one sub-soil-surface cavity. That is, a cement pillar may be formed in the sub-soil-surface cavity and a wide sweep of cement slurry may be squeezed to neighboring areas and cured to strengthen in grouting stabilization operation. This is so because the hydrajetting tool may inject the cement slurry through the hydrajetting nozzles at particularly high velocities, permitting it to permeate or cut deep into the unstable soil, as discussed in more detail below.

As used herein, the term "stable soil" refers to soil capable of providing sufficient load bearing capacity for having a particular infrastructure placed thereon (e.g., a road or building structure, for example). Due to the various types of infrastructure that may be placed upon a particular soil area, the amount of stabilization, or the amount of load bearing capacity sought to be achieved, may vary drastically, as infrastructure varies widely in the amount of load-carrying capacity it may require (e.g., the load-carrying capacity of a small townhome in comparison to a large high rise). The cured cement placed within the sub-soil-surface cavity adjacent to the unstable soil may further serve to stabilize the soil and may be included in the term "stable soil" as used herein. The unstable soil that may be stabilized using the embodiments of the present disclosure may be initially unstable and are made to become stable in anticipation of placing infrastructure thereon. In other instances, the soil may become unstable after infrastructure is placed thereon or after a foundation is placed thereon having infrastructure atop it. That is, the methods described in the present disclosure may be used to stabilize unstable soil alone or even after infrastructure is in place.

In some embodiments, the hydrajetting tool may be used to stabilize unstable rock formations. Unstable rock formations may have a plurality of channels therein. One or more sub-rock-surface cavities may be present in or adjacent to an unstable rock formation. In some embodiments, the hydrajetting tool may be used to form the one or more sub-rock-surface cavities. The hydrajetting tool may be introduced into a sub-rock-surface cavity and a cement slurry may be injected into the unstable rock formation and permeate into the plurality of channels. The cement slurry may also fill the sub-rock-surface cavity. Thereafter, the cement slurry may cure, thereby forming a stable rock formation and a cement pillar in the sub-rock-surface formation. Like the term stable soil, the term "stable rock formation," as used herein, refers to rock formations, including both natural and manmade (e.g., a cement foundation for an infrastructure), that have sufficient load bearing capacity for having a particular infrastructure placed thereon. Again, like the stable soil of the embodiments described herein, certain stable rock formations may provide sufficient load bearing capacity for some infrastructures and not for others. That is, the term "stable" is not constant, but may vary depending upon particular applications. The cured cement placed within the sub-rock-surface cavity adjacent to the unstable rock formation may further serve to stabilize the rock and may be included in the term "stable rock formation" as used herein.

The unstable rock formation that may be stabilized using the embodiments of the present disclosure may be initially unstable and are made to become stable in anticipation of placing infrastructure thereon. In other instances, the rock formation may become unstable after infrastructure is placed thereon. For example, the rock formation itself may be a foundation holding an infrastructure thereon. That is, the methods described in the present disclosure may be used to stabilize unstable rock formations alone or even after infrastructure is in place.

As used herein, the term "unstable composition" may be used to collectively refer to both unstable soil and unstable rock formation, and "stable composition" may be used to collectively refer to both stable soil and unstable rock formation. Additionally, with respect to FIG. 2, the term "sub-surface cavity" may be used to collectively refer to sub-soil-surface cavity and sub-rock-surface cavity. As used herein, the term "sub-soil-surface cavity" refers to an opening, hole, or otherwise shaped breach through the surface of soil, including both stable and unstable soil. As used herein, the term "sub-rock-surface cavity" refers to an opening, hole, or otherwise shaped breach through the surface of a rock formation, including both stable and unstable rock formations.

Figure 2:
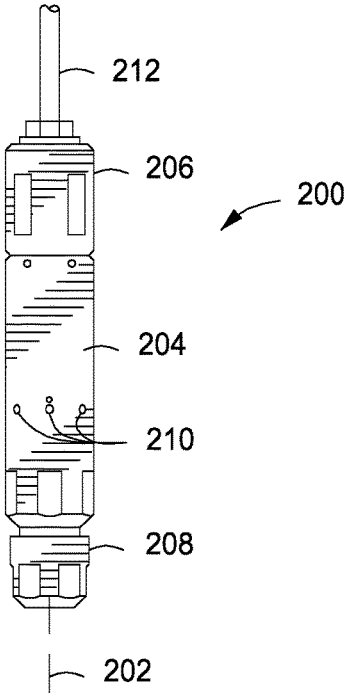
FIG. 2 depicts a hydrajetting tool according to one or more embodiments of the present disclosure.

Referring now to FIG. 2, illustrated is an exemplary hydrajetting tool 200, according to one or more embodiments of the present disclosure. As illustrated, hydrajetting tool 200 may at least include, arranged along the longitudinal axis 202 of the hydrajetting tool 200, a housing 204. The housing 204 may have a top end 206 and a bottom end 208. The housing 204 of the hydrajetting tool 200 may have a plurality of jetting nozzles 210 arranged thereon. The jetting nozzles 210 may be configured such that one or more of the jetting nozzles 210 may eject or otherwise dispel the cement slurry or any other such fluid at an adjustable rate and pressure. In some embodiments, certain jetting nozzles 210 may be configured to eject the cement slurry or fluid at one rate and pressure while other jetting nozzles 210 may be configured to eject the cement slurry or fluid at a different rate and pressure.

The jetting nozzles 210 may be configured to have a screen disposed in-line with the jetting nozzles 210 that filter out any cement particulates in the cement slurry larger than the jetting nozzle 210 itself. Such configuration prevents or reduces the likelihood of clogging the jetting nozzles 210 with components of the cement slurry. The embodiments herein may comprise a hydrajetting tool 200 having jetting nozzles 210 of varying sizes, such that the screen sizes (mesh sizes) may vary depending on the size of the particular jetting nozzle 210 it is in-line with. In some embodiments, it is contemplated that such screens or filter devices may be located at the surface for ease of cleaning and other maintenance activities. Furthermore, the formation of so-called "fish-eye" globules, or conglomerates or droplets of particulates (e.g., partly hydrated polymer), may be common in cement slurries and the screen or filtering devices that may be used in combination with the hydrajetting tool 200 described herein may be equipped with rotary scrapers that push the fish-eyes through the screens or filtering devices. In other embodiments, the jetting nozzles 210 may be configured such that their size alone prevents them from becoming plugged with the cement slurry (e.g., particulates in the cement slurry), while allowing the cement slurry to be ejected at high pressure flow rates.

In some embodiments, the jetting nozzles 210 of the hydrajetting tool 200 may be configured such that a differential pressure across the jetting nozzles 210 in the range of a lower limit of about 2500 psi, 2750 psi, 3000 psi, 3250 psi, 3500 psi, 3750 psi, 4000 psi, 4250 psi, 4500 psi, and 4570 psi to an upper limit of about 7000 psi, 6750 psi, 6500 psi, 6250 psi, 6000 psi, 5750 psi, 5500 psi, 5250 psi, 5000 psi, and 4750 psi is achieved. In some embodiments, the upper limit may be even higher. In other embodiments, such as in very loose soil, the lower limit may be even lower.

In some embodiments, the hydrajetting tool 200 may be rotatable about the longitudinal access 202, thereby capable of injecting a more or less continuous stream of the cement slurry over a greater area (i.e., the jetting nozzles 210 inject the cement slurry as the hydrajetting tool 200 is rotating). Such rotation may be achieved by including one or more swivel components (not shown) either above the top end 206 of the hydrajetting tool 200 or below the bottom end 208 of the hydrajetting tool 200, or both. For applications using jointed tool string 212, the swivel may also be at the surface, above a rotary table that may operate to rotate the pipe and bottomhole assembly ("BHA"). The tool string 212 may be a tubular capable of conveying at least the cement slurry described herein to the hydrajetting tool 200. In some embodiments, the housing 204 of the hydrajetting tool 200 is fluidly coupled to a tool string 212 (e.g., a pipe, coiled tubing, jointed pipe, or other tubular capable of conveying at least the cement slurry to the hydrajetting tool 200) that can be used to place the hydrajetting tool 200 into a sub-surface cavity, as discussed herein, for stabilizing unstable soil or unstable rock formations. The tool string 212 is a tubular capable of conveying at least the cement slurry described herein to the hydrajetting tool 200. In some applications, such as where the tool string 212 is jointed pipe, the swivel may also be at the surface, above a rotary table that may operate to rotate the pipe, for example.

In some embodiments, as illustrated, the housing 204 may be cylindrical in shape and the plurality of jetting nozzles 210 may be disposed about the circumference of the housing. The jetting nozzles 210 may be spaced apart equidistantly along the circumference of the housing 204 of the hydrajetting tool 200 or spaced apart in a planned pattern or randomly, without departing from the scope of the present disclosure. Although three jetting nozzles 210 are shown on the housing 204 of the hydrajetting tool 200, it will be appreciated by one of skill in the art that any number of jetting nozzles 210 may be located on the housing 204 at any location of the hydrajetting tool 200, without departing from the scope of the present disclosure. Moreover, although the housing 204 is depicted as a cylinder, it may be any shape suitable for use in a grouting stabilization operation. For example, in some embodiments, where the hydrajetting tool 200 itself is used to form sub-surface cavities for completing grouting stabilization operations, as discussed below in detail, a tapered housing 204 may be preferred where the diameter of the bottom end 208 is less than the diameter of the top end 206. Such a configuration may aid in placing the hydrajetting tool 200 adjacent to or into unstable soil or unstable rock formation.

In addition to the illustrated embodiment, the hydrajetting tool 200 of the present disclosure may further comprise additional components operatively coupled thereto, such as a stabilizer capable of keeping the hydrajetting tool 200 from rotating, one or more additional housings 204 arranged along the longitudinal axis 202 above or below the illustrated hydrajetting tool 200 to increase the hydrajetting area that a particular hydrajetting tool 200 may achieve. Moreover, the structural arrangement of the hydrajetting tool 200 itself may vary, without departing from the scope of the present invention (e.g., the hydrajetting tool 200 may be along a horizontal axis, rather than a longitudinal axis), and any additional components may be structurally arranged in any combination with the components of the illustrated hydrajetting tool 200, provided that it is capable of injecting a cement slurry to stabilize unstable soil or unstable rock formation.

In some exemplary embodiments, the additional component on the hydrajetting tool 200 may be a drill bit, auger, or other additional cutting device, collectively referred to herein as "drill bit," below the bottom end 208 of the hydrajetting tool 200. The drill bit may be any type of cutting device known to those of skill in the art including, but not limited to, a roller cone bit, a solid diamond cutter, a diamond-impregnated drill bit, a hammer bit, a polycrystalline diamond compact cutter, and the like. The drill bit may be a fixed-cutter bit, an antiwhirl bit, and the like. In those embodiments in which the hydrajetting tool 200 is used to form sub-surface cavities in unstable soil or unstable rock formations, the drill bit may synergistically operate in concert with the hydrajetting tool 200 to form the sub-surface cavities.

The drill bit (not shown) may be fluidly coupled to the tool string 212 and may further comprise one or more nozzles thereon. The nozzles may be placed at any location on the drill bit and in some exemplary embodiments may be angled downward. The nozzles may be capable of expelling the cement slurry from the tool string 212 therethrough (e.g., cement slurry that is not expelled through the jetting nozzles 210 on the hydrajetting tool 200). The nozzles on the drill bit may expel the cement slurry at the same high pressure rate of the hydrajetting tool 200 or may expel the cement slurry at a pressure lower, and in some cases, such as by using chokes, significantly lower, than the hydrajetting tool 200. Moreover, if more than one nozzle is disposed on the drill bit, they may eject the cement slurry at different or the same pressures. Ejection of the cement slurry at low pressures through one or more nozzles disposed on the drill bit may facilitate the circulation of material that has been cut by the action of the drill bit and the hydrajetting tool. The nozzles may be any size and shape and in some preferred embodiments, the nozzles on the drill bit may be larger in size to facilitate circulation of material as compared to the size of the jetting nozzles 210 on the hydrajetting tool 200. It will be appreciated by one of skill in the art, that even if the hydrajetting tool 200 including the drill bit is not used to form the sub-surface cavities, the nozzles on the drill bit (e.g., pointed downward or angularly downward), if included, may beneficially assist the grouting stabilization operation by enhancing circulation, for example.

Figure 3:
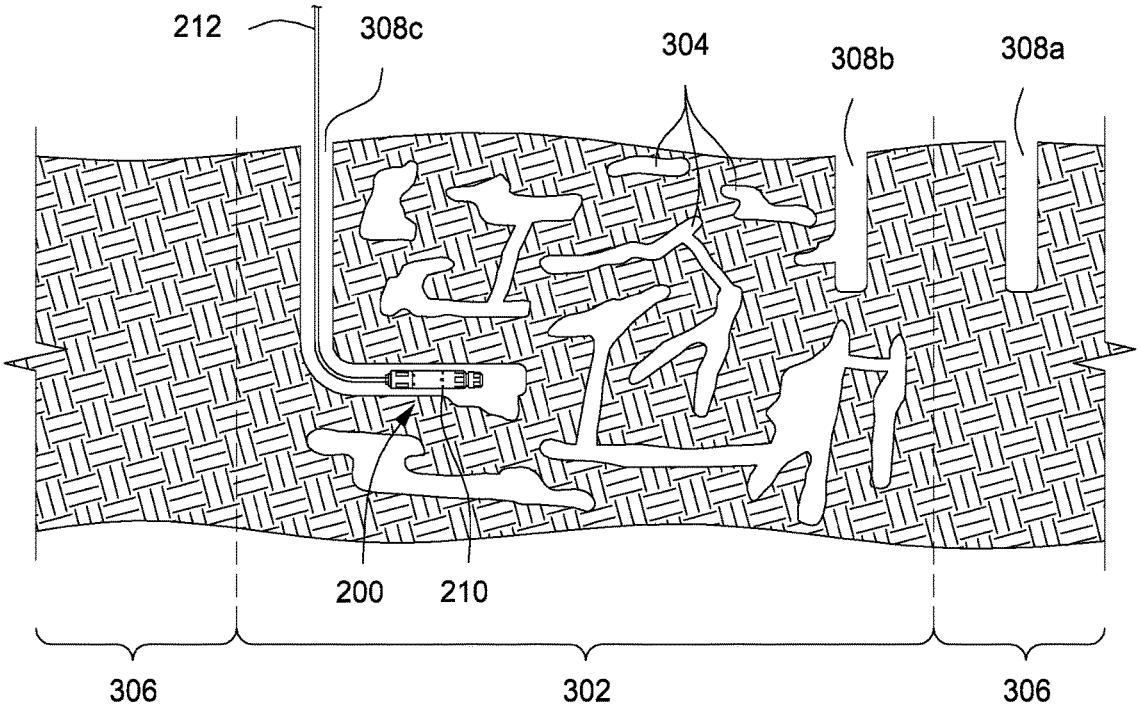
FIGS. 3, 4A-4B, and 5 depict grouting stabilization operations using a hydrajetting tool according to one or more embodiments of the present disclosure.

Referring now to FIG. 3, an unstable composition 302 (e.g., either unstable soil or unstable rock formation) is depicted having a plurality of channels 304 therein. Stable compositions 306 are depicted on either side of the unstable composition 302. A plurality of sub-surface cavities, 308*a, b, c* (collectively referred to as "308") (e.g., sub-soil-surface or sub-rock-surface cavities), are illustrated. In some embodiments, as depicted by 308*a*, a sub-surface cavity may be formed adjacent to the unstable composition 302, such as in a stable composition 306, as shown. In such instances, the cement slurry may be pumped through the stable composition 306 and into the unstable composition 302. In other embodiments, as depicted by 308*b,c*, a sub-surface cavity may be formed directly in the unstable composition 302. When the sub-surface cavity 308 is formed directly in the unstable composition 302, as depicted by 308*b,c*, the sub-surface cavity may directly intersect or otherwise bisect one or more channels 304 in the unstable composition 302. In accordance with the present disclosure, it is not necessary that at least one sub-surface cavity be either in or adjacent to the unstable composition 302. That is, one or more sub-surface cavities 308 may be located only within the stable composition 306, adjacent to the unstable composition 302. In other instances, one or more sub-surface cavities may be located only within the unstable composition 302.

Referring still to FIG. 3, with continued reference to FIG. 2, the sub-surface cavities 308 may be formed by any means known to those of skill in the art. In some embodiments, the sub-surface cavities 308 may be formed by manual digging, for example. In other embodiments, the sub-surface cavities 308 may be drilled with conventional drilling tools and methods. In some preferred embodiments, the sub-surface cavities 308 may themselves be drilled with the hydrajetting tool 200, guided into the unstable composition 302 or the stable composition 306 by the tool string 212. The cement slurry described herein may be pumped through the tool string 212 and through one or more jetting nozzles 210 at a rate and pressure sufficient to form the sub-surface cavities 308. In some embodiments, as discussed above, a drill bit may be fluidly coupled to the tool string 212 and may be used in conjunction with the hydrajetting tool 200 to form the sub-surface cavities. The drill bit may further comprise one or more nozzles through which the cement slurry may be ejected. In some embodiments, a different fluid may be used to form the sub-surface cavities 308, such as an abrasive fluid comprising a base fluid (e.g., the aqueous base fluids described herein) and a cutting particulate. The cutting particulate may be any solid particulate that once ejected through the jetting nozzles 210, and/or nozzles on the optional drill bit, is capable of forming the sub-surface cavities 308 in the particular unstable composition 302 or stable composition 306 in which the sub-surface cavity 308 is being formed. In some embodiments, a base fluid alone, without a cutting particulate, may be sufficient to form the sub-surface cavities 308.

While any abrasive fluid may be used with the hydrajetting tool 200 to form the sub-surface cavities 308, in preferred embodiments, where the hydrajetting tool 200 is used, the cement slurry may be preferably used so as to permeate through the plurality of channels in the unstable composition 302 while forming the sub-surface cavities 308. Moreover, no fluid change-out is required, although such may be done continuously, which may reduce the equipment footprint at the worksite, among other advantages.

The shape, depth, and width of the sub-surface cavities 308 may vary depending on the particular unstable composition 302 being treated based on a number of factors including, but not limited to, the depth of the unstable composition 302, the number and configuration of the channels in the unstable composition 302, the load bearing capacity the unstable composition 302 is expected to achieve, and the like. In some instances, the sub-surface cavity 308 may be substantially perpendicular to the surface of the unstable composition 302 or stable composition 306 (see 308*a,b*). In other instances, the sub-surface cavity 308 may have a first portion substantially perpendicular to the surface of the unstable composition 302 or stable composition 306 and a second portion that is substantially horizontal to the surface of the unstable composition 302 or the stable composition 306 (see 308*c*). It will be appreciated by one in the art, however, that any other shape of the sub-surface cavity 308 may be utilized in accordance with the embodiments herein, without departing from the scope of the present disclosure. For example, the sub-surface cavity 308 may be continuously sloping, deviated, zig-zag shaped, curved, or any other suitable shape.

Although FIG. 3 illustrates three sub-surface cavities 308, it will be appreciated by one of skill in the art that any number of sub-surface cavities 308 may be utilized for a particular grouting stabilization operation, without departing from the scope of the present disclosure. In particular, the number of sub-surface cavities 308, like their size, width, and depth, may depend on the particular unstable composition 302 being treated. For example, in unstable compositions 302 having channels 304 that are substantially interconnected, a single sub-surface cavity 308 may be sufficient to permeate the cement slurry through the interconnected channels upon ejection from the jetting nozzles 210, and/or nozzles on the optional drill bit, of the hydrajetting tool 200. In those instances where the unstable composition 302 has substantially disconnected channels, multiple sub-surface cavities 308 may be desirable to achieve the wanted stable composition. In some embodiments, the cement slurry may itself form openings in the unstable composition 302, these openings intersecting one or more channels 304 therein and permeating the cement slurry into the channels 304. Thereafter, the cement slurry in the formed openings and the channels 304 may cure, thereby forming a stable composition. In yet other embodiments, the cement slurry may itself form openings in the unstable composition 302, which may cure into a hardened cement mass without permeating the channels 304 in the unstable composition 302. Such embodiments, described below, may be formed by the pressure cement slurry from the hydrajetting tool 200. That is, the cement slurry may be pumped into the unstable composition 302 at a rate and pressure sufficient to expand the width of the sub-surface cavity 308 from its original width. In some instances, although not in all, a stable composition may be formed by cementing the newly formed openings alone, forming cement pillars. It is likely, although not always the case, that such openings would intersect or otherwise bisect the channels 304 in the unstable composition 302, particularly if such channels 304 are relatively uniformly spaced in the unstable composition 302.

Referring still to FIG. 3, with continued reference to FIG. 2, the cement slurry may be injected into the unstable composition 302 through at least one of the jetting nozzles 210 on the hydrajetting tool 200, and/or nozzles on the optional drill bit. To do so, the hydrajetting tool 200 may be lowered into the sub-surface cavities 308 formed in either or both of the unstable composition 302 or the stable composition 306. The hydrajetting tool 200 may be lowered on the tool string 212 fluidly coupled to the hydrajetting tool 200. In those embodiments in which the hydrajetting tool 200, with or without an optional drill bit, is used to form the sub-surface cavities 308, the hydrajetting tool 200 may already be in place to inject the cement slurry (i.e., if a different fluid was used to form the sub-surface cavities 308).

Figure 4A:
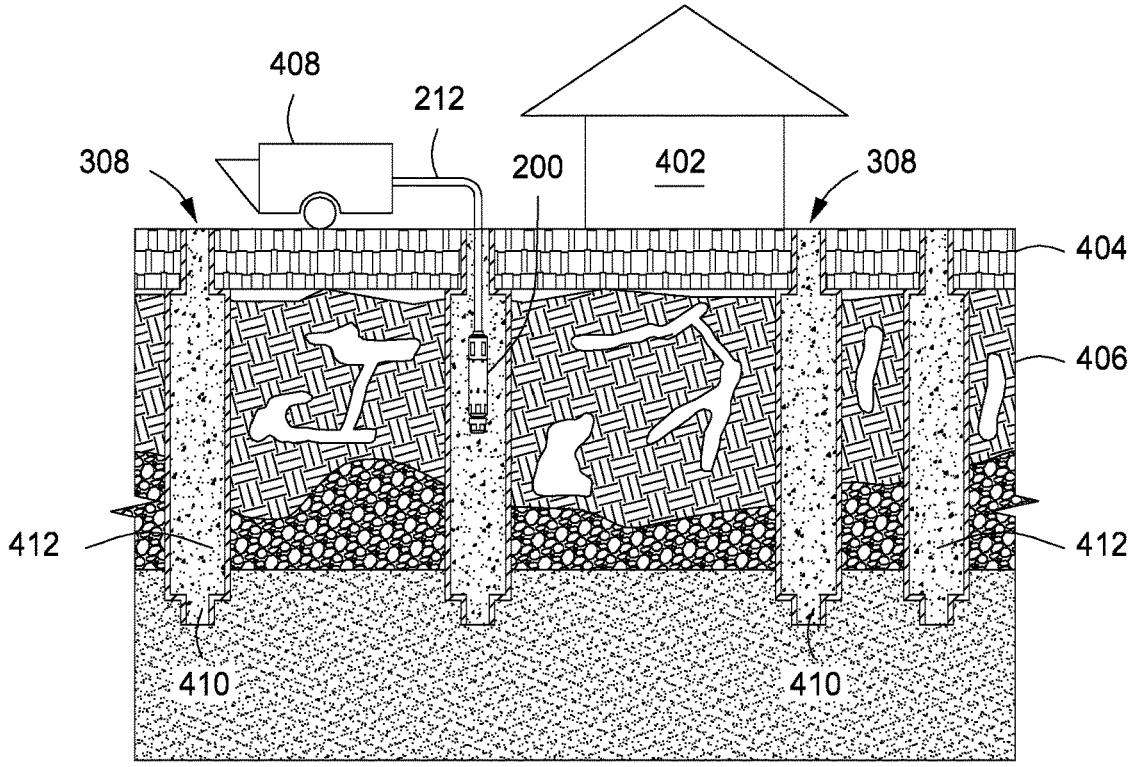

Referring now to FIGS. 4A,B, with continued reference to FIGS. 2 and 3, illustrated is an exemplary application of the hydrajetting tool 200 of the embodiments described herein. As mentioned previously, an advantage of the embodiments herein is that the hydrajetting tool 200 may expand the width (e.g., circumference or diameter) of a sub-surface cavity 308, as compared to conventional grouting stabilization processes, which are limited to the size of the cavity, formed by a drill bit, for example. As depicted in FIG. 4A, infrastructure 402 positioned atop foundation 404, which is atop unstable composition 406 (e.g., unstable soil or unstable rock formation). A cement pump 408 is fluidly connected to the hydrajetting tool 200 by tool string 212. Although FIG. 4A depicts a stationary cement pump, it will be appreciated by one of skill in the art that the cement pump may be installed in a truck or other moveable structure and may further be capable of lowering and lifting the hydrajetting tool 200 and/or capable of facilitating drill of the sub-surface cavities 308, with or without the optional drill bit being part of the hydrajetting tool 200, without departing from the scope of the present disclosure. The sub-surface cavities 308 may be pre-drilled or drilled with the hydrajetting tool 200, with or without an optional drill bit which may or may not include additional nozzles. The drilled sub-surface cavity may have an initial width 410.

Referring still to FIG. 4A, the hydrajetting tool 200 may be lowered into the sub-surface cavities 308 if pre-formed and/or lowered to form the sub-surface cavities 308, and cement slurry may be ejected from the hydrajetting nozzles 210 of the hydrajetting tool 200, and/or nozzles on the optional drill bit, at a very high pressure sufficient to displace (e.g., by abrasion or cutting, for example) the unstable composition 406, thereby forming a larger or wider area than the initial width 410 that may be cemented with the cured cement slurry to stabilize the unstable composition 406 and form a cement pillar 412. In some embodiments, the hydrajetting tool 200 may be rotated while it is injecting the cement slurry. In such embodiments, the rotary motion may be provided by the cement pump 408, a drilling rig, a workover rig (including hydraulic workover units), and the like, or if the tool string 212 is coil tubing, the rotary motion may be provided by a mud motor type drilling system. The high pressure ejection of the cement slurry allows deep displacement of the unstable composition 406 and the unstable composition 406 may mix with the cement slurry, creating soil cement or rock cement, depending on the type of unstable composition 406 being treated. In some embodiments, the cement slurry and displaced unstable composition 406 mixture may be allowed to cure and form a cement pillar 412. The presence of the particulates of the unstable composition 406 in the cured cement pillar 412 may increase its strength. In other embodiments, the cement slurry and displaced unstable composition 406 may be at least partially removed from the sub-surface cavity 308 and fresh cement slurry may be placed therein to cure and form the cement pillar 412, which may be placed by any means, including use of the hydrajetting tool 200 at low pressure. Although a large amount of the cement slurry and displaced unstable composition 406 may be removed, it will be appreciated by one of skill in the art that at least some of the mixture will remain in the sub-surface cavity 308.

Use of the hydrajetting tool 200 while ejecting cement slurry in an unstable composition 406, any un-displaced (e.g., uncut) unstable composition 406 contacted by the cement slurry may have cement mixed therewith, which may cure to form a portion of the cement pillar 412, thus resulting in "perfect contact" between the cement pillar 412 and the unstable composition 406. Such "perfect contact" does not result when a drill is used to abrade the unstable composition 406, followed by cement placement because during the transition between abrasion and cement placement, mud or other liquids from the soil seep into the space between the unstable composition 406 and the cement. In such cases, channeling may be likely to occur.

Although the cement pillars 412 depicted in FIG. 4A are depicted as perpendicular to the foundation 404 (i.e., the surface), it will be appreciated by one of skill in the art, that any shape may be achieved, as discussed above, with the methods of the present disclosure, without departing from the scope of the disclosure. Unlike conventional methods, the hydrajetting tool 200 described herein may allow for the formation of large width cement pillars 412. In some embodiments, the cement pillars 412 may have a diameter width of less than about 10 feet ("ft") in diameter. In exemplary embodiments, the cement pillar 412 may have a diameter width in the range of a lower limit of about 6 ft, 6.1 ft, 6.2 ft, 6.3 ft, 6.4 ft, 6.5 ft, 6.6 ft, 6.7 ft, 6.8 ft, 6.9 ft, 7 ft, 7.1 ft, 7.2 ft, 7.3 ft, 7.4 ft, 7.5 ft, 7.6 ft, 7.7 ft, 7.8 ft, 7.9 ft, 8 ft, and 8.1 ft to an upper limit of about 10 ft, 9.9 ft, 9.8 ft, 9.7 ft, 9.6 ft, 9.5 ft, 9.4 ft, 9.3 ft, 9.2 ft, 9.1 ft, 9 ft, 8.9 ft, 8.8 ft, 8.7 ft, 8.6 ft, 8.5 ft, 8.4 ft, 8.3 ft, 8.2 ft, and 8.1 ft. The large width of the cement pillars 412 by use of the hydrajetting tool 200 described herein provides for enhanced stabilization.

Figure 4B:
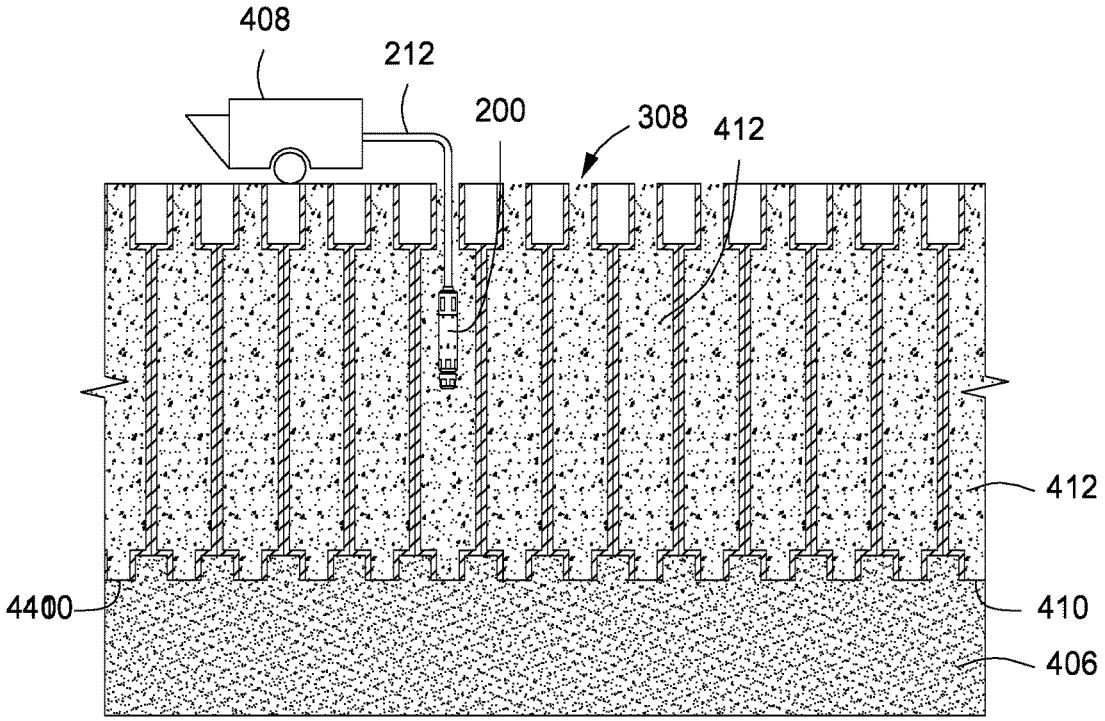

Referring now to FIG. 4B, illustrated is a grouting stabilization technique in which a wall of cement pillars 412 may be formed using the hydrajetting tool 200 described herein. Multiple large cement pillars 412 formed using the hydrajetting tool 200 may be placed in the unstable composition 406 according to one or more methods described herein. As depicted, the cement pillars 412 may abut one another by ejecting the cement slurry through the jetting nozzles 210 of the hydrajetting tool 200 at a pressure sufficient to reach a neighboring cement pillar 412 after it has cured, or to reach neighboring cement slurry and displaced unstable composition 406 mixtures (or the cement slurry alone if the mixture is removed and replaced with fresh cement slurry). In some embodiments, then, individual cement pillars 412 may be formed, as depicted, or one large cement pillar 412 may be formed by intermixing the cement slurry (and/or displaced unstable composition 406) of neighboring sub-surface cavities 308 prior to allowing the cement slurry to cure, in both cases essentially forming a "wall." Further, it will be appreciated by one of skill in the art, that the cement pillars 412 need not necessarily abut one another, but may instead have a portion of the unstable composition 406 therebetween of any width, based on the specifications of a particular grouting stabilization operation.

Figure 5:
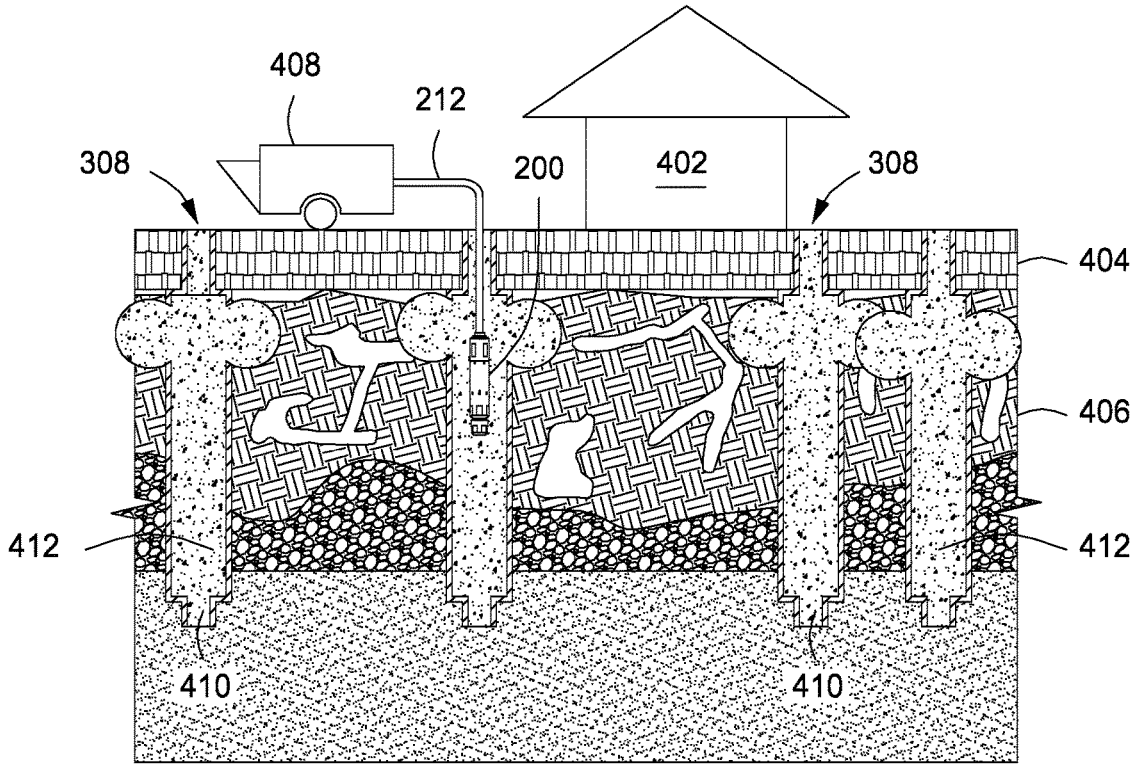

Referring now to FIG. 5, with continued reference to FIGS. 4A,B, illustrated is another type of grouting stabilization operation that may be performed according to one or more embodiments of the present disclosure. The hydrajetting tool 200 may be used to form cement pillars 412 that are of a mixed shape. One such shape, as depicted, is a modified "T" shape, where the hydrajetting tool 200 is used to displace the unstable composition 406 in two different directions (i.e., horizontally and vertically). One advantage of the embodiments described herein is that the tubing string 212 may be selected such that it allows substantial mobility of the hydrajetting tool 200, so as to tailor the shape of the cement pillar 412 to a particular grouting stabilization operation.

It will be appreciated by one of skill in the art that the cement pillar "wall" in FIG. 4B may be used to stabilize unstable compositions 406, but may also be used to form a circle around a particular unstable composition or other type of area of interest such as, for example, a lake (e.g., to prevent water migration) or a hazardous waste site (e.g., to prevent leaching into ground water or other water sources), and the like. Moreover, the directional drilling, as shown in FIG. 5, of the embodiments herein may be used to further isolate a peculiar area, such as by using horizontal cement pillars below or above the area of interest. In some embodiments, the cement pillars described herein may completely isolate an area of interest on all sides.

Referring again to FIGS. 2 and 3, in some embodiments, once the hydrajetting tool 200 is in place in the sub-surface cavity 308, a cement slurry may be delivered through the tool string 212, into the hydrajetting tool 200, with or without the optional drill bit, and into the unstable composition 302 (or into the unstable composition 302 through a stable composition 306) through one or more jetting nozzles 210 and/or nozzles on the optional drill bit. In various embodiments, the portion of the tool string 212 that is not connected to the hydrajetting tool 200 may be fluidly coupled to a pump. The tool string 212, as mentioned previously, may be used to lower the hydrajetting tool 200 into a sub-surface cavity 308, as depicted in FIG. 3. The tool string 212 may be configured to convey or otherwise deliver the cement slurries of the present disclosure to the hydrajetting tool 200 for injection into the unstable composition 302 through the jetting nozzles 210 and/or nozzles on the optional drill bit. The pump may be, for example, a high pressure pump or a low pressure pump, which may depend on, inter alia, the viscosity and density of the cement slurry, the type of unstable composition 302, and the like.

In some embodiments, a mixing tank may be arranged upstream of the pump and in which the cement slurry is formulated. In various embodiments, the pump (e.g., a low pressure pump, a high pressure pump, or a combination thereof) may convey the cement slurry from the mixing tank or other source of the cement slurry to the tool string 212. In other embodiments, however, the cement slurry may be formulated offsite and transported to a worksite, in which case the cement slurry may be introduced to the tool string 212 via the pump directly from a transport vehicle or a shipping container (e.g., a truck, a railcar, a barge, or the like) or from a transport pipeline. In yet other embodiments, the cement slurry may be formulated on the fly at the grouting stabilization worksite where components of the cement slurry are pumped from a transport (e.g., a vehicle or pipeline) and mixed during introduction into the tool string 212. In any case, the cement slurry may be drawn into the pump, elevated to an appropriate pressure and then introduced into the tool string 212 for delivery to the hydrajetting tool 200.

In some embodiments, the cement slurry of the present disclosure may comprise a base fluid and a cementitious material. Any aqueous base fluid suitable for use in forming a curable cement slurry capable of use in a grouting stabilization operation. Suitable base fluids may include, but are not limited to, freshwater; saltwater (e.g., water containing one or more salts dissolved therein); brine (e.g., saturated saltwater); seawater; and any combination thereof. Generally, the base fluid may be from any source provided, for example, that it does not contain an excess of compounds that may undesirably affect the pumpability through the hydrajetting tool 200 or the curing capability of the cement slurry.

The cementitious material of the embodiments herein may be any cementitious material suitable for use in forming a curable cement slurry capable of use in a grouting stabilization operation. In preferred embodiments, the cementitious material may be a hydraulic cement. Hydraulic cements harden by the process of hydration due to chemical reactions to produce insoluble hydrates (e.g., calcium hydroxide) that occur independent of the cement's water content (e.g., hydraulic cements can harden even under constantly damp conditions). Thus, hydraulic cements are preferred because they are capable of hardening regardless of the water content of a particular subterranean formation. Suitable hydraulic cements include, but are not limited to Portland cement; Portland cement blends (e.g., Portland blast-furnace slag cement and/or expansive cement); non-Portland hydraulic cement (e.g., super-sulfated cement, calcium aluminate cement, and/or high magnesium-content cement); and any combination thereof.

In some embodiments, the cement slurry may additionally comprise a pozzolanic material. Pozzolanic materials may aid in increasing the density and strength of the cementitious material. As used herein, the term "pozzolanic material" refers to a siliceous material that, while not being cementitious, is capable of reacting with calcium hydroxide (which may be produced during hydration of the cementitious material). Because calcium hydroxide accounts for a sizable portion of most hydrated hydraulic cements and because calcium hydroxide does not contribute to the cement's properties, the combination of cementitious and pozzolanic materials may synergistically enhance the strength and quality of the cement. Any pozzolanic material that is reactive with the cementitious material may be used in the embodiments herein. Suitable pozzolanic materials may include, but are not limited to, silica fume; metakaolin; fly ash; diatomaceous earth; calcined or uncalcined diatomite; calcined fullers earth; pozzolanic clays; calcined or uncalcined volcanic ash;

bagasse ash; pumice; pumicite; rice hull ash; natural and synthetic zeolites; slag; vitreous calcium aluminosilicate; and any combinations thereof. In some embodiments, the pozzolanic material may be present in an amount in the range of a lower limit of about 5%, 7.5%, 10%, 12.5%, 15%, 17.5%, 20%, 22.5%, 25%, 27.5%, 30%, and 32.5% to an upper limit of about 60%, 57.5%, 55%, 52.5%, 50%, 47.5%, 45%, 42.5%, 40%, 37.5%, 35%, and 32.5% by weight of the dry cementitious material.

In some embodiments, the cement slurry may further comprise any cement additive for use in forming a curable cement slurry capable of use in a grouting stabilization operation. Cement additives may be added in order to modify the characteristics of the cement slurry, for example. Such cement additives include, but are not limited to, a defoamer; a cement accelerator; a cement retarder; a fluid-loss additive; a cement dispersant; a cement extender; a weighting agent; a lost circulation additive; and any combination thereof. The cement additives of the embodiments herein may be in any form, including powder form or liquid form.

It will be appreciated by one of skill in the art, that the cement slurry may be modified during a particular grouting stabilization operation by altering the components of the cement slurry. For example, in some embodiments, a grouting stabilization operation may be begun with a relatively thin cement slurry (e.g., about 9 to about 12 pound per gallon ("lb/gal"), which may allow better circulation of the displaced unstable composition. Thereafter, towards the latter part of the operation, a heavier weighted slurry that will facilitate curing may be used (e.g., greater than about 16 lb/gal). In some instances, fine material (e.g., fine particulates from the displaced unstable composition) may be circulated out of the sub-surface cavities, whereas larger material (e.g., rocks, pebbles, or larger particulates of displaced unstable composition) may remain and improve the compressive strength of the cement slurry and/or cement slurry and displaced unstable composition mixture.

Embodiments herein include:

A. A method comprising: providing a hydrajetting tool comprising a housing having a top end and a bottom end and having a plurality of jetting nozzles disposed thereon, the top end of the housing fluidly coupled to a tool string; providing at least one sub-soil-surface cavity adjacent to or in unstable soil, the unstable soil having a plurality of channels therein; introducing the hydrajetting tool into the at least one sub-soil-surface cavity; injecting a cement slurry through at least one of the jetting nozzles and into the sub-soil-surface cavity; permeating the cement slurry into the plurality of channels in the unstable soil; filling the at least one sub-soil-surface cavity with the cement slurry; and curing the cement slurry, thereby forming a stable soil and a cement pillar in the at least one sub-soil-surface cavity.

Embodiment A may have one or more of the following additional elements in any combination:

Element 1A: Wherein the hydrajetting tool further comprises a drill bit below the bottom end and in fluid communication with the tool string.

Element 2A: Wherein the hydrajetting tool is used to form the at least one sub-soil-surface cavity.

Element 3A: Wherein infrastructure is atop the unstable soil.

Element 4A: Wherein infrastructure having a rock formation foundation is atop the unstable soil.

Element 5A: Wherein the housing is cylindrical and the plurality of jetting nozzles are disposed about the circumference of the housing.

Element 6A: Wherein the housing is rotatable about the tool string.

Element 7A: Wherein the cement slurry is expelled through at least one of the plurality of jetting nozzles at an adjustable rate and pressure.

Element 8A: Wherein the cement slurry comprises a base fluid and cementitious material.

Element 9A: Wherein the cement slurry further comprises a pozzolanic material.

By way of non-limiting example, exemplary combinations applicable to A include: A with 1A and 4A; A with 2A, 8A, and 9A; A with 3A, 4A, 5A, and 6A.

B. A method comprising: providing a hydrajetting tool comprising a housing having a top end and a bottom end and having a plurality of jetting nozzles disposed thereon, the top end of the housing fluidly coupled to a tool string; providing at least one sub-rock-surface cavity adjacent to or in an unstable rock formation, the unstable rock formation having a plurality of channels therein; introducing the hydrajetting tool into the at least one sub-rock-surface cavity; injecting a cement slurry through at least one of the jetting nozzles and into the sub-rock-surface cavity; permeating the cement slurry into the plurality of channels in the unstable rock formation; filling the at least one sub-rock-surface cavity with the cement slurry; and curing the cement slurry, thereby forming a stable rock formation and a cement pillar in the at least one sub-rock-surface cavity.

Embodiment B may have one or more of the following additional elements in any combination:

Element 1B: Wherein the hydrajetting tool further comprises a drill bit below the bottom end and in fluid communication with the tool string.

Element 2B: Wherein the hydrajetting tool is used to form the at least one sub-rock-surface cavity.

Element 3B: Wherein the rock formation is a foundation for infrastructure.

Element 4B: Wherein the housing is cylindrical and the plurality of jetting nozzles are disposed about the circumference of the housing.

Element 5B: Wherein the housing is rotatable about the tool string.

Element 6B: Wherein the cement slurry is expelled through at least one of the plurality of jetting nozzles at an adjustable rate and pressure.

Element 7B: Wherein at least one removable bridge plug is located at least one location on the tool string above the top end of the housing and on the tool string below the bottom end of the housing.

Element 8B: Wherein the cement slurry comprises a base fluid and cementitious material.

Element 9B: Wherein the cement slurry further comprises a pozzolanic material.

By way of non-limiting example, exemplary combinations applicable to B include: B with 2B, 3B, and 8B; B with 5B, and 9B; B with 6B and 7B.

Therefore, the embodiments disclosed herein are well adapted to attain the ends and advantages mentioned as well as those that are inherent therein. The particular embodiments disclosed above are illustrative only, as they may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The embodiments illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The invention claimed is:

1. A method comprising:

forming a sub-soil-surface cavity in unstable soil, the unstable soil having a plurality of channels therein, wherein the at least one sub-soil-surface cavity intersects at least one of the plurality of channels;

introducing a hydrajetting tool into the sub-soil-surface cavity, wherein the hydrajetting tool comprises, a housing having a plurality of jetting nozzles disposed thereon between a top end and a bottom end of the housing, wherein a top end of the housing is fluidly coupled to a tool string that conveys slurry to the hydrajetting tool; and a drill bit disposed below the housing and fluidly coupled to the tool string, wherein the drill bit includes one or more drill bit nozzles; and during rotation of the housing and drill bit, ejecting the slurry through of the jetting nozzles at a first pressure into the sub-soil-surface cavity, and ejecting the slurry through the one or more drill bit nozzles into the sub-soil-surface cavity at a second pressure that is lower than the first pressure.

2. The method of claim 1, wherein the hydrajetting tool is used to form the sub-soil-surface cavity.

3. The method of claim 1, wherein infrastructure is atop the unstable soil.

4. The method of claim 1, wherein infrastructure having a rock formation foundation is atop the unstable soil.

5. The method of claim 1, wherein the housing is cylindrical and the plurality of jetting nozzles are disposed about the circumference of the housing.

6. The method of claim 1, wherein the housing is rotatable about the tool string.

7. The method of claim 1, wherein the slurry is expelled through at least one of the plurality of jetting nozzles at an adjustable rate and pressure.

8. The method of claim 7, wherein the slurry further comprises a pozzolanic material.

9. The method of claim 1, wherein the slurry comprises a base fluid and cementitious material.

10. A method comprising:

forming a sub-rock-surface cavity in an unstable rock formation having a plurality of channels therein, the plurality of channels defining a plurality of flow paths through the unstable rock formation, wherein the sub-rock-surface cavity intersects at least one of the plurality of channels;

introducing a hydrajetting tool into the sub-rock-surface cavity, wherein the hydrajetting tool comprises, a housing having a plurality of jetting nozzles disposed thereon between a top end and a bottom end of the housing, wherein a top end of the housing is fluidly coupled to a tool string that conveys slurry to the hydrajetting tool; and a drill bit disposed below the housing and fluidly coupled to the tool string, wherein the drill bit includes one or more drill bit nozzles; and during rotation of the housing and the drill bit, ejecting the slurry through the jetting nozzles and through the one or more drill bit nozzles into the sub-rock-surface cavity.

11. The method of claim 10, wherein the hydrajetting tool is used to form the sub-rock-surface cavity.

12. The method of claim 10, wherein the rock formation is a foundation infrastructure.

13. The method of claim 10, wherein the housing is cylindrical and the plurality of jetting nozzles are disposed about the circumference of the housing.

14. The method of claim 10, wherein the housing is rotatable about the tool string.

15. The method of claim 10, wherein the slurry is expelled through at least one of the plurality of jetting nozzles at an adjustable rate and pressure.

16. The method of claim 10, wherein at least one removable bridge plug is located at least one location on the tool string above the top end of the housing and on the tool string below the bottom end of the housing.

17. The method of claim 10, wherein the slurry comprises a base fluid and cementitious material.

18. The method of claim 17, wherein the slurry further comprises a pozzolanic material.

19. The method of claim 10, wherein said ejecting the slurry through the jetting nozzles and the drill bit nozzles comprises ejecting the slurry through the jetting nozzles at a first pressure into the sub-rock-surface cavity and ejecting the slurry through the one or more drill bit nozzles into the sub-rock-surface cavity at a second pressure that is lower than the first pressure.

* * * * *